US010633151B2

(12) United States Patent
Philip et al.

(10) Patent No.: US 10,633,151 B2
(45) Date of Patent: Apr. 28, 2020

(54) CHILD RESISTANT DROPPER CLOSURE

(71) Applicant: AMCOR RIGID PLASTICS USA, LLC, Wilmington, DE (US)

(72) Inventors: Bradley S. Philip, Tecumseh, MI (US); Todd Mastic, Saline, MI (US); Peter Bates, Sylvania, OH (US)

(73) Assignee: AMCOR RIGID PLASTICS USA, LLC, Wilmington, DE (US)

( * ) Notice: Subject to any disclaimer, the term of this patent is extended or adjusted under 35 U.S.C. 154(b) by 218 days.

(21) Appl. No.: 15/736,900

(22) PCT Filed: Jun. 16, 2015

(86) PCT No.: PCT/US2015/036020
§ 371 (c)(1),
(2) Date: Dec. 15, 2017

(87) PCT Pub. No.: WO2016/204732
PCT Pub. Date: Dec. 22, 2016

(65) Prior Publication Data

US 2018/0362226 A1 Dec. 20, 2018

(51) Int. Cl.
*B65D 50/04* (2006.01)
*B65D 47/18* (2006.01)

(52) U.S. Cl.
CPC ..... *B65D 50/041* (2013.01); *B65D 47/18* (2013.01)

(58) Field of Classification Search
CPC ..... B65D 50/041; B65D 47/18; B65D 47/00; B65D 51/24

(Continued)

(56) References Cited

U.S. PATENT DOCUMENTS 2,964,207 A * 12/1960 Towns ..... B65D 50/041 215/220
3,260,393 A * 7/1966 Roberts ..... B65D 50/041 215/220

(Continued)

FOREIGN PATENT DOCUMENTS

WO 2010013131 A1 2/2010
WO 2015062771 A1 5/2015

OTHER PUBLICATIONS

International Search Report and Written Opinion for PCT/US2015/036020, dated Mar. 16, 2016; ISA/KR.

(Continued)

*Primary Examiner* — Ernesto S Grano
(74) *Attorney, Agent, or Firm* — Harness, Dickey & Pierce, P.L.C.

(57) ABSTRACT

A child resistant closure for a container including an inner portion and an outer portion. The inner portion includes internal threads, a plurality of ramped springs, and a plurality of inner drive teeth. The plurality of ramped springs are spaced apart circumferentially about a longitudinal axis of the closure. The plurality of inner drive teeth are spaced apart circumferentially about the longitudinal axis outboard of the plurality of ramped springs. The outer portion is seated over the inner portion and includes a plurality of protrusions spaced apart circumferentially about the longitudinal axis and configured to contact the plurality of ramped springs. The outer portion also includes a plurality of outer drive teeth spaced apart circumferentially about the longitudinal axis outboard of the plurality of protrusions and configured to contact the plurality of inner drive teeth.

21 Claims, 9 Drawing Sheets

(58) Field of Classification Search
USPC ..... 215/220
See application file for complete search history.

(56) References Cited

U.S. PATENT DOCUMENTS

| | | | | |
|---|---|---|---|---|
| 3,679,085 | A * | 7/1972 | Gach | B65D 50/041 215/220 |
| 3,797,688 | A * | 3/1974 | Porcelli | B65D 50/041 215/220 |
| 3,857,505 | A * | 12/1974 | Mumford | B65D 50/041 215/220 |
| 3,917,098 | A | 11/1975 | Acton et al. | |
| 3,944,102 | A * | 3/1976 | Grau | B65D 50/041 215/251 |
| 4,319,690 | A * | 3/1982 | Birrell | B65D 50/041 215/220 |
| 5,020,681 | A * | 6/1991 | Kusz | B65D 50/041 215/220 |
| 5,638,970 | A * | 6/1997 | Garby | A61J 7/04 116/308 |
| 8,245,860 | B2 * | 8/2012 | Farrar | B65D 41/06 215/222 |
| 8,474,634 | B1 | 7/2013 | Branson et al. | |
| 8,833,577 | B2 * | 9/2014 | Habibi-Naini | B65D 50/041 215/200 |
| 9,586,738 | B2 * | 3/2017 | Herrbach | B65D 41/3409 |
| 9,802,737 | B2 * | 10/2017 | Wuethrich | B65D 1/023 |
| 9,902,535 | B2 * | 2/2018 | Faragher | B65D 50/041 |
| 10,011,408 | B2 * | 7/2018 | Pucci | B65D 41/045 |
| 10,039,913 | B2 * | 8/2018 | Yeh | A61M 39/1011 |
| 10,202,224 | B2 * | 2/2019 | Painchaud | B65D 47/00 |
| 10,220,989 | B2 * | 3/2019 | Painchaud | B05B 11/04 |
| D848,843 | S * | 5/2019 | Uetsuki | D9/452 |
| 10,414,561 | B1 * | 9/2019 | Moghaddam | B65D 50/041 |
| 2004/0099627 | A1 * | 5/2004 | Yan | B65D 50/041 215/220 |
| 2004/0262251 | A1 * | 12/2004 | Tauber | B65D 50/041 215/220 |
| 2005/0150857 | A1 | 7/2005 | Brozell et al. | |
| 2009/0032486 | A1 | 2/2009 | Brozell et al. | |
| 2012/0061343 | A1 | 3/2012 | Habibi-Naini | |
| 2012/0138561 | A1 * | 6/2012 | Brozell | B65D 50/041 215/220 |
| 2015/0166224 | A1 * | 6/2015 | Greiner-Perth | B65D 47/2068 222/153.06 |
| 2016/0167838 | A1 * | 6/2016 | Dong | B65D 41/0492 220/255 |
| 2017/0129662 | A1 * | 5/2017 | Decock | B05B 11/0032 |

OTHER PUBLICATIONS

Supplementary Partial European Search Report issued in corresponding European Application No. 158957852 dated Dec. 21, 2018.

Supplementary European Search Report issued in corresponding European Application No. 15895785.2 dated Apr. 9, 2019 (10 pages).

* cited by examiner

CHILD RESISTANT DROPPER CLOSURE

CROSS REFERENCE TO RELATED APPLICATION

This application is a U.S. National Phase Application under 35 U.S.C. 371 of International Application No. PCT/US2015/036020 filed on Jun. 16, 2015 and published as WO 2016/204732 A1 on Dec. 22, 2016. The entire disclosure of the above application is incorporated herein by reference.

FIELD

The present disclosure relates to a child resistant dropper closure.

BACKGROUND

This section provides background information related to the present disclosure, which is not necessarily prior art.

Child resistant closures are often used to make it difficult for children to gain access to medication or other substances that may be harmful to them if not used as directed. While existing child resistant closures are suitable for their intended use with large containers, they are not suitable for small containers. For example, current child resistant closures are too large for use with small containers, such as dropper containers. A child resistant closure suitable for use with smaller containers, such as dropper containers with a finish having a diameter of 13 mm or 15 mm for example, would therefore be desirable.

SUMMARY

This section provides a general summary of the disclosure, and is not a comprehensive disclosure of its full scope or all of its features.

The present teachings provide for a child resistant closure for a container including an inner portion and an outer portion. The inner portion includes internal threads, a plurality of ramped springs, and a plurality of inner drive teeth. The plurality of ramped springs are spaced apart circumferentially about a longitudinal axis of the closure. The plurality of inner drive teeth are spaced apart circumferentially about the longitudinal axis outboard of the plurality of ramped springs. The outer portion is seated over the inner portion and includes a plurality of protrusions spaced apart circumferentially about the longitudinal axis and configured to contact the plurality of ramped springs. The outer portion also includes a plurality of outer drive teeth spaced apart circumferentially about the longitudinal axis outboard of the plurality of protrusions and configured to contact the plurality of inner drive teeth.

The present teachings also provide for a child resistant closure for a container including inner and outer portions. The inner portion has internal threads and a plurality of ramped springs. The ramped springs are spaced apart circumferentially about a longitudinal axis of the closure, and are inboard of the internal threads and finish threads of the container such that the plurality of ramped springs are closer to the longitudinal axis than both the internal threads and the finish threads. A plurality of inner drive teeth are spaced apart circumferentially about the longitudinal axis outboard of the plurality of ramped springs. The outer portion is seated over the inner portion and includes a plurality of protrusions spaced apart circumferentially about the longitudinal axis and configured to contact the plurality of ramped springs. A plurality of outer drive teeth are spaced apart circumferentially about the longitudinal axis outboard of the plurality of protrusions and are configured to contact the plurality of inner drive teeth.

The present teachings further provide for a child resistant closure for a container including an inner portion having internal threads, a plurality of ramped springs, and a plurality of inner drive teeth. The internal threads are configured to cooperate with a finish of the container. The plurality of ramped springs are spaced apart circumferentially about a longitudinal axis of the closure. Each one of the plurality of ramped springs includes a first end, a second end opposite to the first end, and a ramped surface extending from the first end towards the second end. The plurality of ramped springs are: inboard of the internal threads; inboard of the finish threads; curved from the first end to the second end so as to be concave relative to the longitudinal axis; and do not extend beyond an outer diameter of the finish of the container such that the plurality of ramped springs are closer to the longitudinal axis than both the internal threads and the finish threads. The plurality of inner drive teeth are spaced apart circumferentially about the longitudinal axis outboard of the plurality of ramped springs. The outer portion is seated over the inner portion and includes a plurality of protrusions spaced apart circumferentially about the longitudinal axis and each including a sloped portion configured to contact the plurality of ramped springs. The plurality of outer drive teeth are spaced apart circumferentially about the longitudinal axis outboard of the plurality of protrusions and are configured to contact the plurality of inner drive teeth. The annular flange is between the plurality of protrusions and the plurality of outer drive teeth. The annular flange extends to an area of the inner portion between the plurality of ramped springs and the plurality of inner drive teeth.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
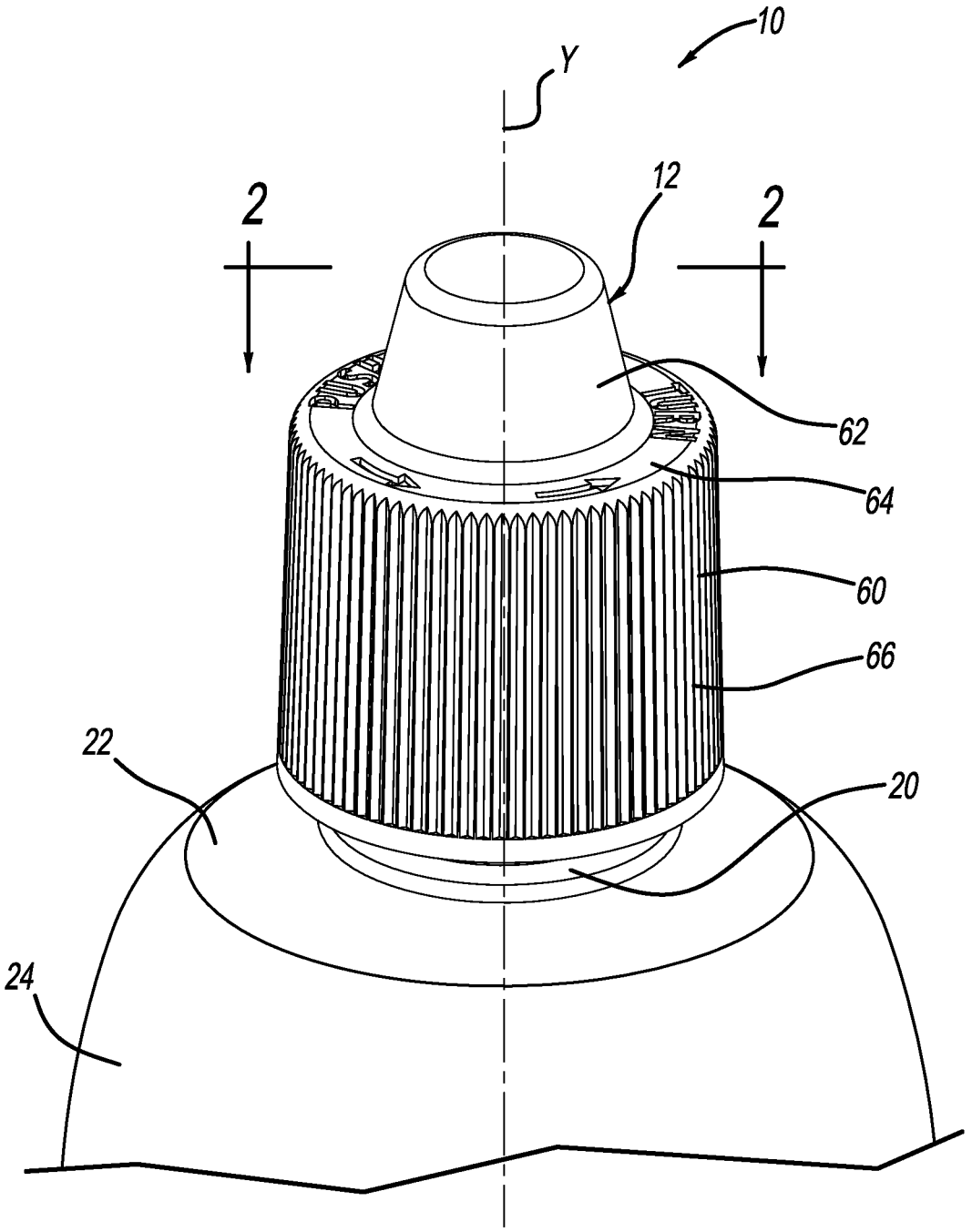
FIG. 1 is a perspective view of a child resistant closure according to the present teachings secured to a dropper container.
Figure 2:
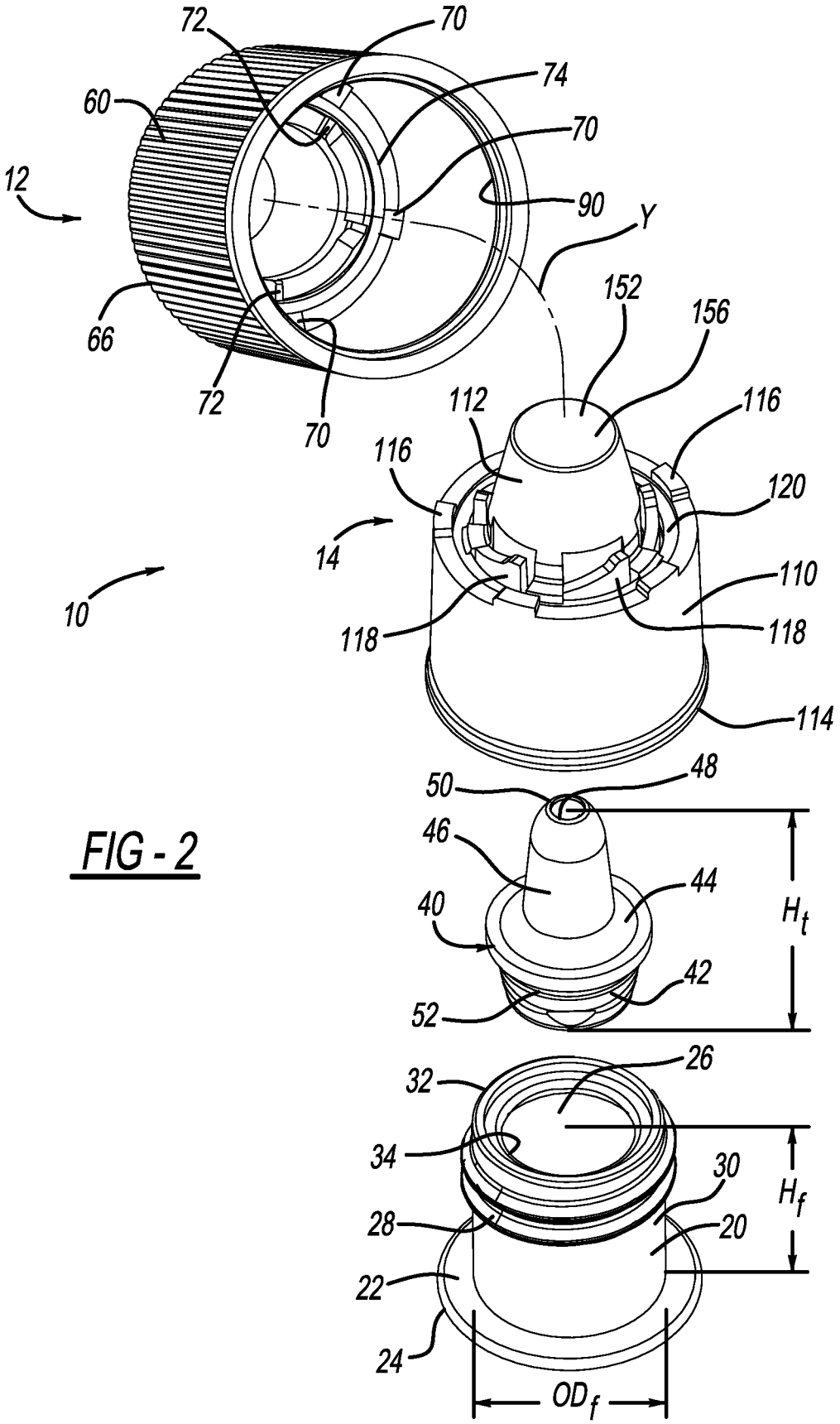
FIG. 2 is an exploded view of the closure of FIG. 1, a dropper tip of the container, and a threaded finish of a container.

With initial reference to FIGS. 1 and 2, a child resistant closure according to the present teachings is generally illustrated at reference numeral 10. The closure 10 is configured to couple with a finish of any suitable container, such as an dropper container or bottle, in order to open and close the container as described herein. The closure 10 generally includes an outer portion 12 seated on an inner portion 14. The outer and inner portions 12 and 14 can be manufactured in any suitable manner and can be made of any suitable material. For example, the outer and inner portions 12 and 14 can be manufactured using any suitable injection molding process, and can be made of, for example, polyethylene terephthalate (PET), low-density polyethylene (LDPE), high-density polyethylene (HDPE), or polypropylene (PP).

With particular reference to FIG. 2, an exemplary finish to which the closure 10 can be coupled to is illustrated by reference numeral 20. The finish 20 extends from an upper portion 22 of an exemplary container 24. The container 24 can be any suitable container or bottle, such as a dropper container configured to store any suitable solution and dispense the solution as individual droplets. The finish 20 defines a passageway 26 extending through the finish 20. A plurality of finish threads 28 extend from an outer surface 30 of the finish 20. The finish 20 defines an opening 32 at an end of the finish 20 opposite to the upper portion 22 of the container 24. Extending from the finish 20 into the passageway 26 proximate to the opening 32 is a finish flange 34.

The finish 20 can have any suitable height Hf and any suitable outer diameter ODf. For example, the finish 20 can have a height Hf measured from the upper portion 22 of the container 24 to the opening 32 of about 14 mm, or about 12 mm to 16 mm. The finish 20 can have an outer diameter ODf measured across opposite portions of the finish threads 28 extending from the outer surface 30 of about 14 mm, or about 12 mm to 16 mm.

Figure 10:
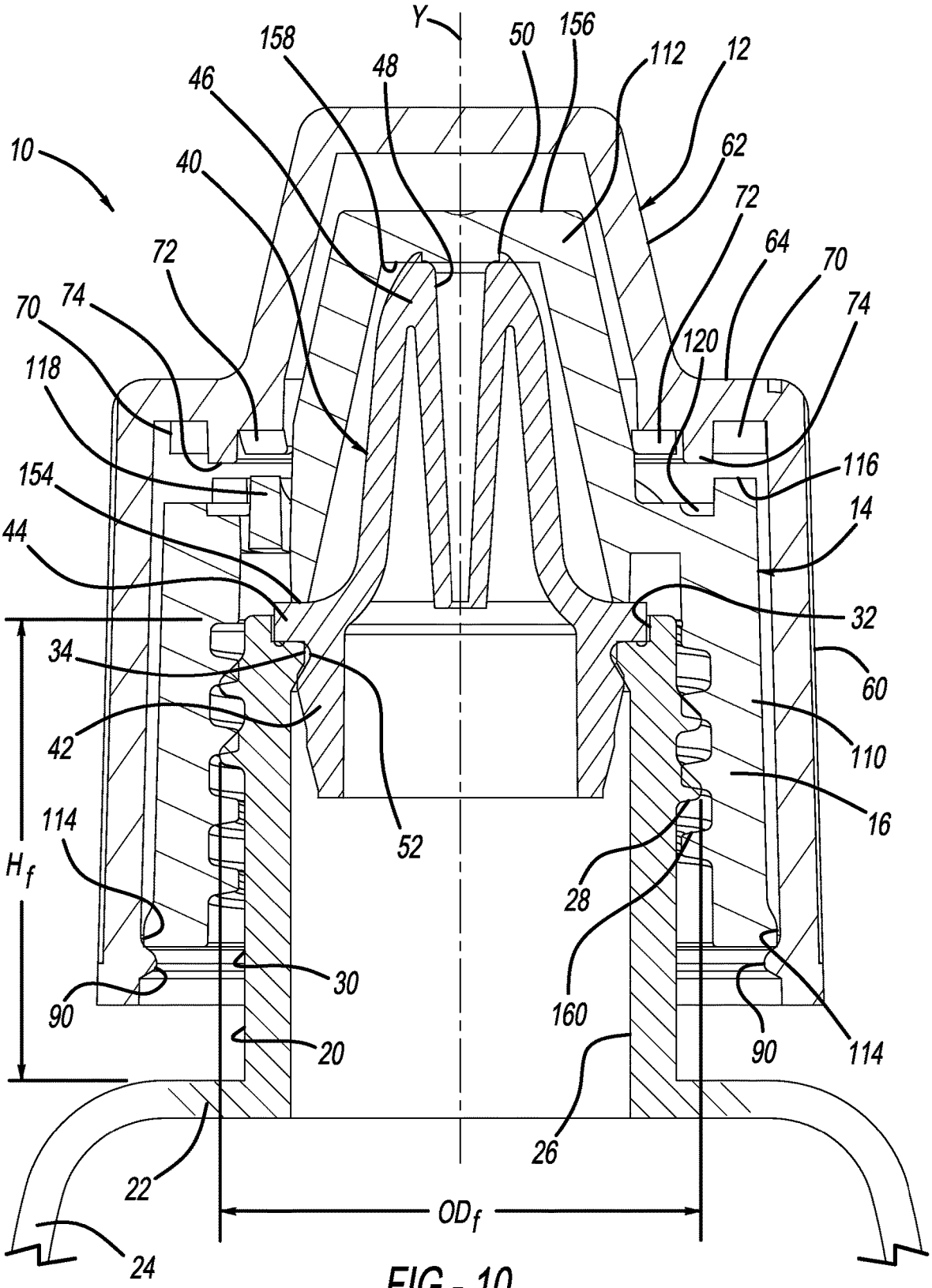
FIG. 10 is a cross-sectional view of the closure secured to the dropper container.
Figure 11:
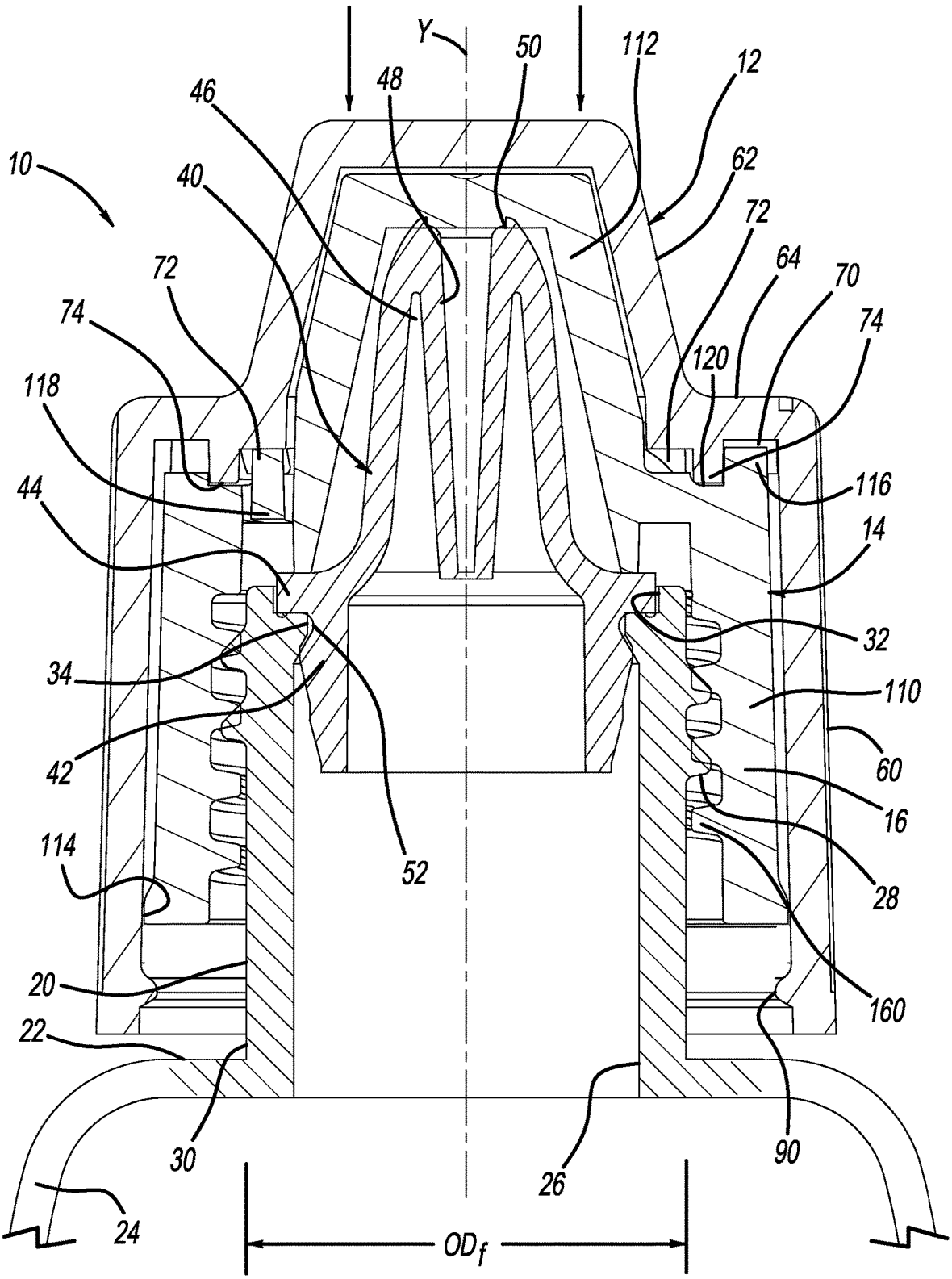
FIG. 11 is a cross-sectional view of the closure secured to the dropper container with the outer portion of the closure pressed onto the inner portion of the closure.

The closure 10 and the finish 20 are configured to accommodate any suitable tip, such as an extended control dropper tip 40 (see FIG. 2 for example). The extended control dropper tip 40 generally includes a base 42, a tip flange 44, and a spout 46. The tip flange 44 is between the base 42 and the spout 46. The spout 46 defines an opening 48 at a distal end 50 of the spout 46. As illustrated in FIGS. 2, 10, and 11 for example, a recess 52 is defined by the base 42 proximate to the tip flange 44. The dropper tip 40 can have any suitable overall height Ht, as measured from the bottom of the base 42 to the distal end 50. For example, the overall height Ht can be about 15 mm for example.

The base 42 is seated within the finish 20 and secured therein through cooperation between the finish flange 34 and the recess 52. More specifically, the tip 40 is secured to the finish 20 with a snap fit coupling between the finish flange 34 and the recess 52. The extended control dropper tip 40 is configured to dispense contents of the container 24 as droplets having any suitable size, which is generally determined based on the size and shape of the spout 46.

With continued reference to FIGS. 1 and 2 and additional reference to FIGS. 3 and 4, the outer portion 12 of the closure 10 will now be described further. The outer portion 12 generally includes an outer body 60, an outer cone portion 62, and a shoulder 64 between the outer body 60 and the outer cone portion 62. Extending outward from the body 60 are a plurality of ribs 66, which extend vertically along a height of the outer body 60. The ribs 66 facilitate gripping of the outer portion 12 when the closure 10 is being screwed onto and off of the finish 20.

Figure 3:
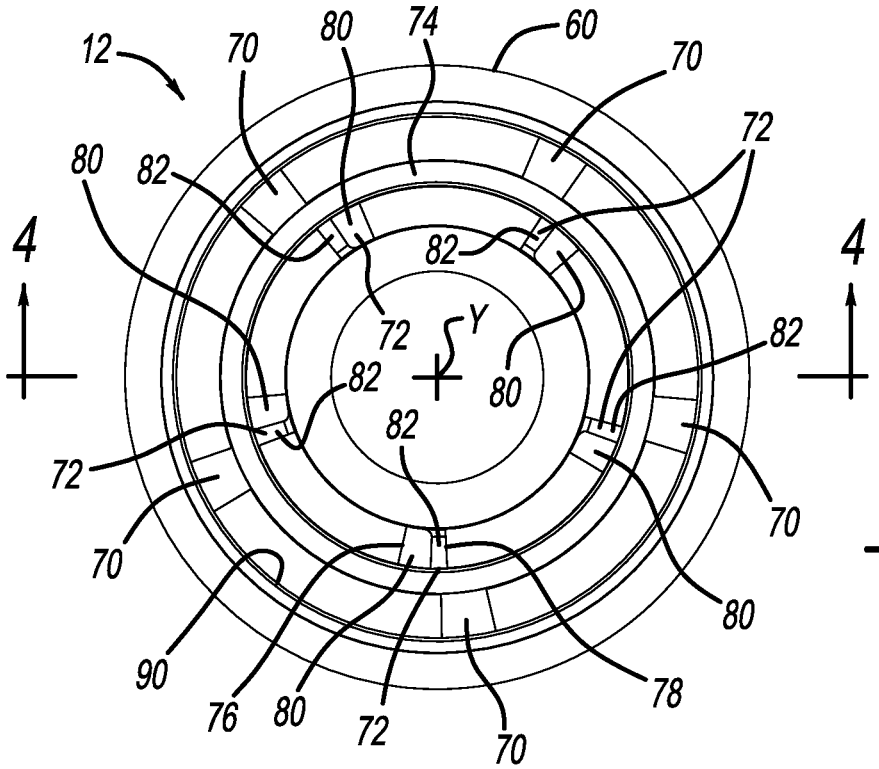
FIG. 3 is a plan view of an inside of an outer portion of the closure of FIG. 1.

With particular reference to FIGS. 2 and 3, an interior of the outer portion 12 includes a plurality of outer drive teeth 70 spaced apart about a longitudinal axis Y, which extends through a radial center of the outer and inner portions 12 and 14, as well as the overall closure 10. The outer drive teeth 70 generally extend from an inner surface of the shoulder 64 towards the body 60. The interior of the outer portion 12 further includes a plurality of protrusions 72 spaced apart circumferentially about the longitudinal axis Y. Between the outer drive teeth 70 and the protrusions 72 is an annular flange 74. The annular flange 74 extends from an inner surface of the shoulder 64 towards the body 60.

Figure 5:
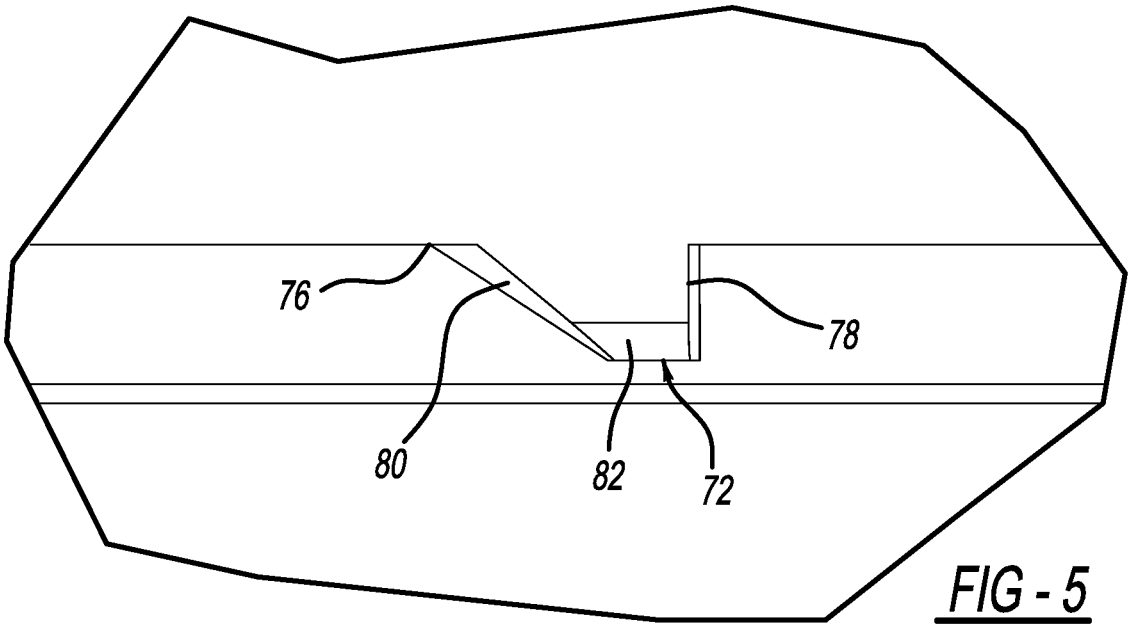
FIG. 5 is a close-up view of area 5 of FIG. 4.

As illustrated in FIG. 5 for example, each one of the protrusions 72 includes a first end 76, a second end 78, a sloped portion or surface 80, and a planar portion 82. The second end 78 is opposite to the first end 76. The sloped surface 80 extends from the first end 76 towards and to the planar portion 82. The planar portion 82 extends from the sloped surface 80 to the second end 78. When viewed from the perspective of looking into the outer body 60 as illustrated in the exemplary embodiment, the sloped surfaces 80 extend from the first end 76 towards the second end 78 in a counterclockwise direction.

Figure 4:
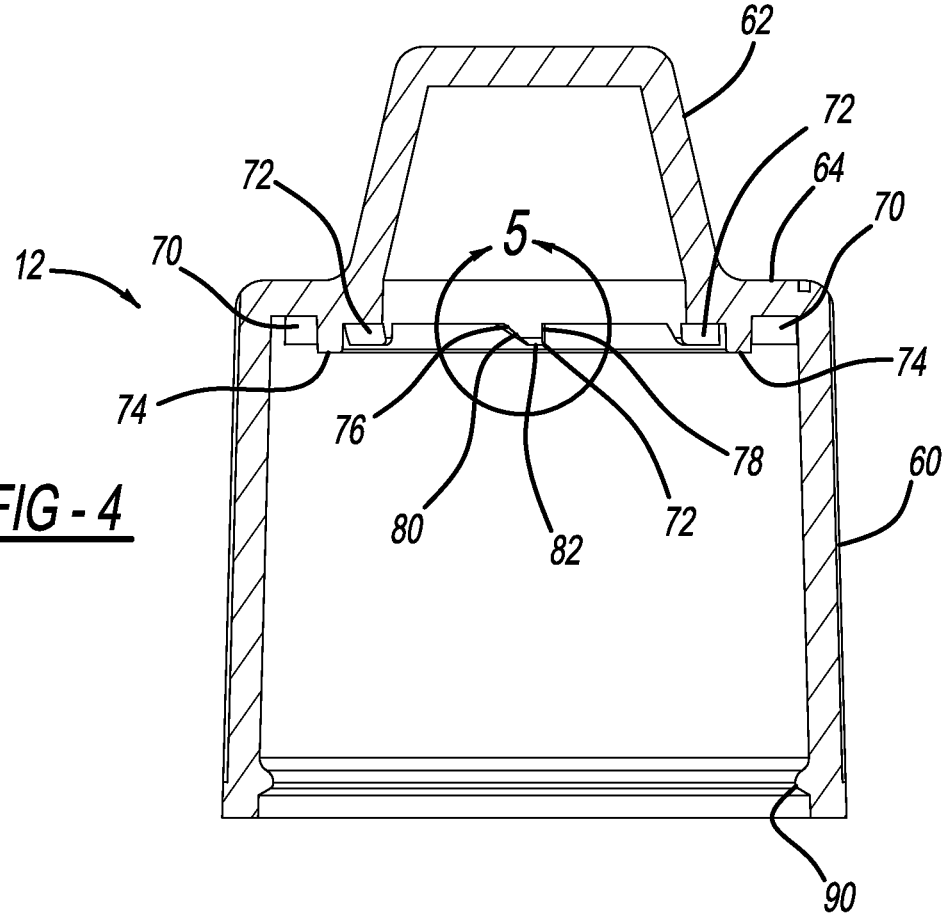
FIG. 4 is a cross-sectional view taken along line 4-4 of FIG. 3.

As illustrated in FIG. 4 for example, a retaining bead 90 is provided at an end of the body 60 opposite to the outer drive teeth 70, the protrusions 72, and the annular flange 74. The retaining bead 90 extends inward towards the longitudinal axis Y about an inner diameter of the body 60. As described herein, the retaining bead 90 is configured to couple with the outer portion 12 to prevent the outer portion 12 from being lifted off of the inner portion 14.

With continued reference to FIG. 2 and additional reference to FIGS. 6-8, the inner portion 14 will now be described further. The inner portion 14 includes an inner body 110 and an inner cone portion 112 extending therefrom. At an end of the inner body 110 opposite to the inner cone portion 112 is a skirt 114. The skirt 114 extends outward from the inner body 110 around a periphery thereof and is configured to abut retaining bead 90 of the outer portion 12 to prevent the outer portion 12 from being lifted off of the inner portion 14. A plurality of inner threads 160 are at an interior of the inner body 110.

At the end of the inner body 110 from which the inner cone portion 112 extends are a plurality of inner drive teeth 116 spaced apart circumferentially about the longitudinal axis Y. Inboard of the inner drive teeth 116 are a plurality of ramped springs 118, which are also circumferentially spaced apart about the longitudinal axis Y. Between the inner drive teeth 116 and the ramped springs 118 is an annular channel 120. The longitudinal axis Y extends through an axial center of the annular channel 120.

Figure 6:
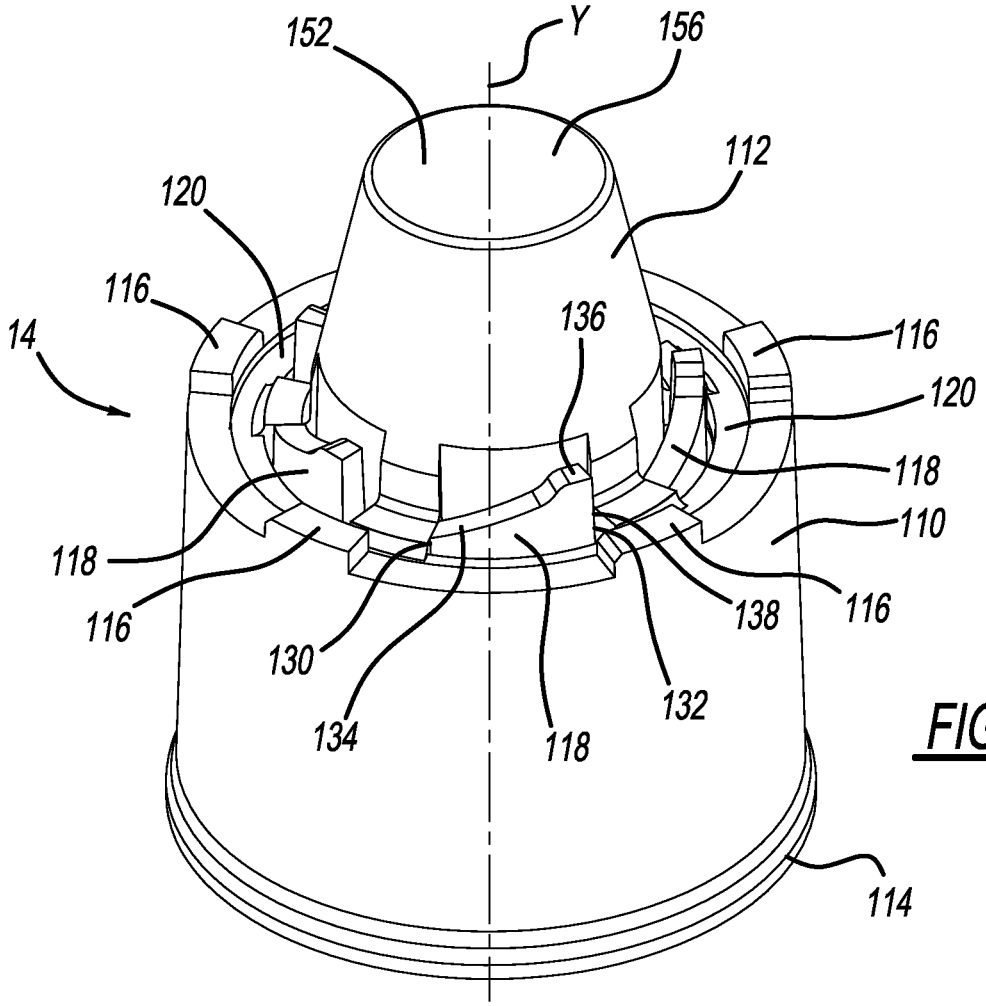
FIG. 6 is a perspective view of an inner portion of the closure of FIG. 1.
Figure 7:
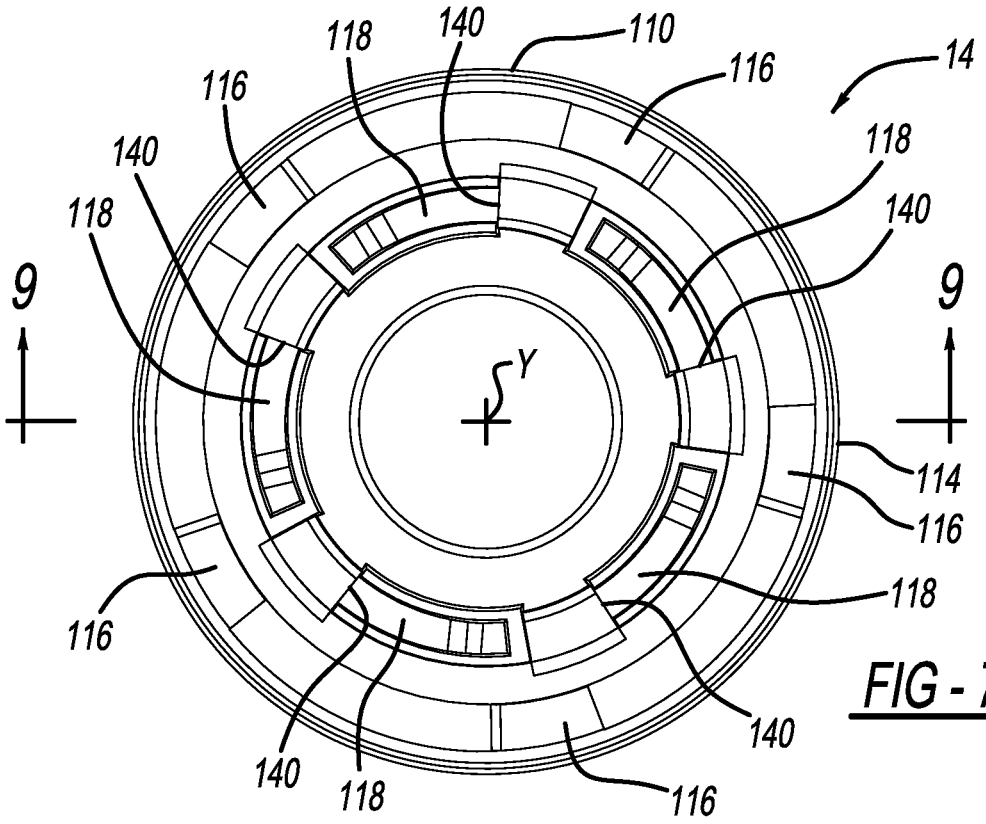
FIG. 7 is a plan view of an inside of the inner portion of FIG. 6.
Figure 8:
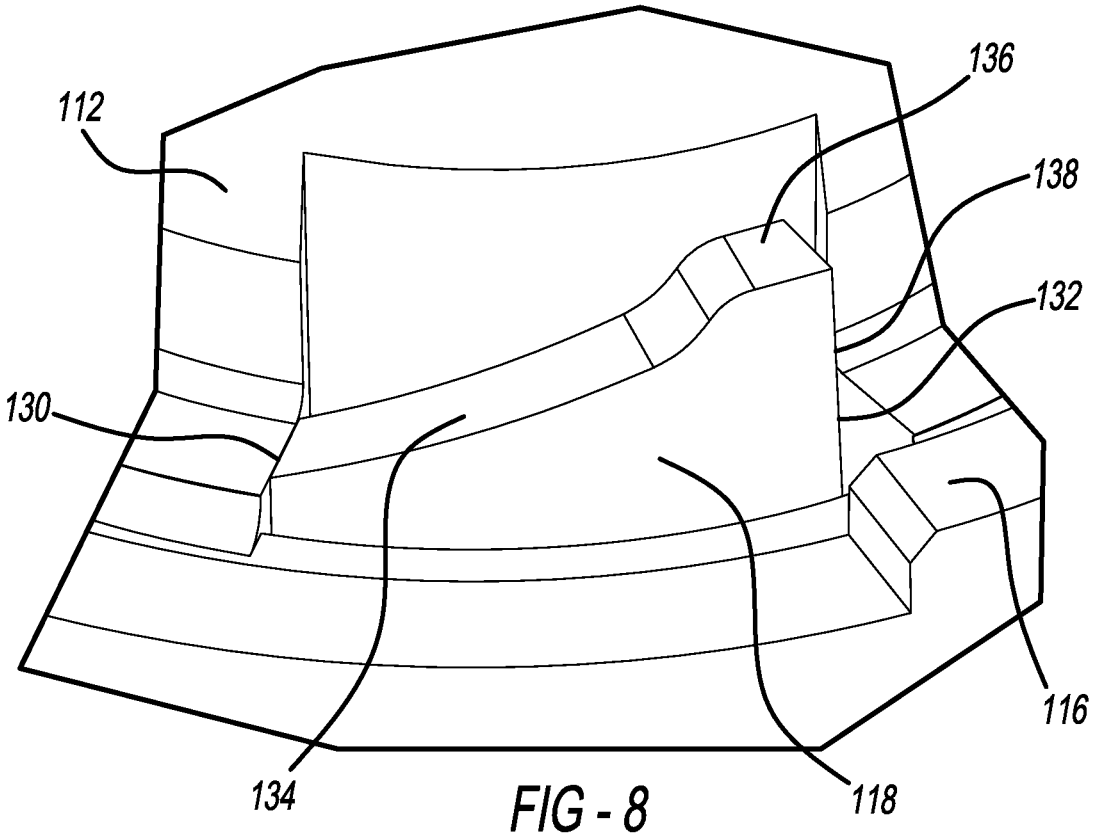
FIG. 8 is a perspective view of a ramped spring of the inner portion of FIG. 6.

As illustrated in FIGS. 6 and 8 for example, each one of the ramped springs 118 includes a first end 130 and a second end 132 that is opposite to the first end 130. Each one of the ramped springs 118 is curved from the first end 130 to the second end 132 such that each ramped spring 118 is concave relative to the longitudinal axis Y. Extending from the first end 130 towards the second end 132 is an upper ramped surface 134. The upper ramped surface 134 extends from the first end 130 to raised teeth 136, which are raised above the upper ramped surface 134. Opposite to the upper ramped surface 134 is a lower ramped surface 142.

The raised teeth 136 extends from the ramped surface 134 to the second end 132. At the second end 132 is a face 138, which extends substantially vertical and parallel to the longitudinal axis Y. The face 138 extends to the raised teeth 136. Each one of the ramped springs 118 is flexible about a hinge 140 (see FIG. 7 for example) at the first end 130. The ramped springs 118 flex into the inner body 110 in a direction generally parallel to the longitudinal axis Y.

Figure 9:
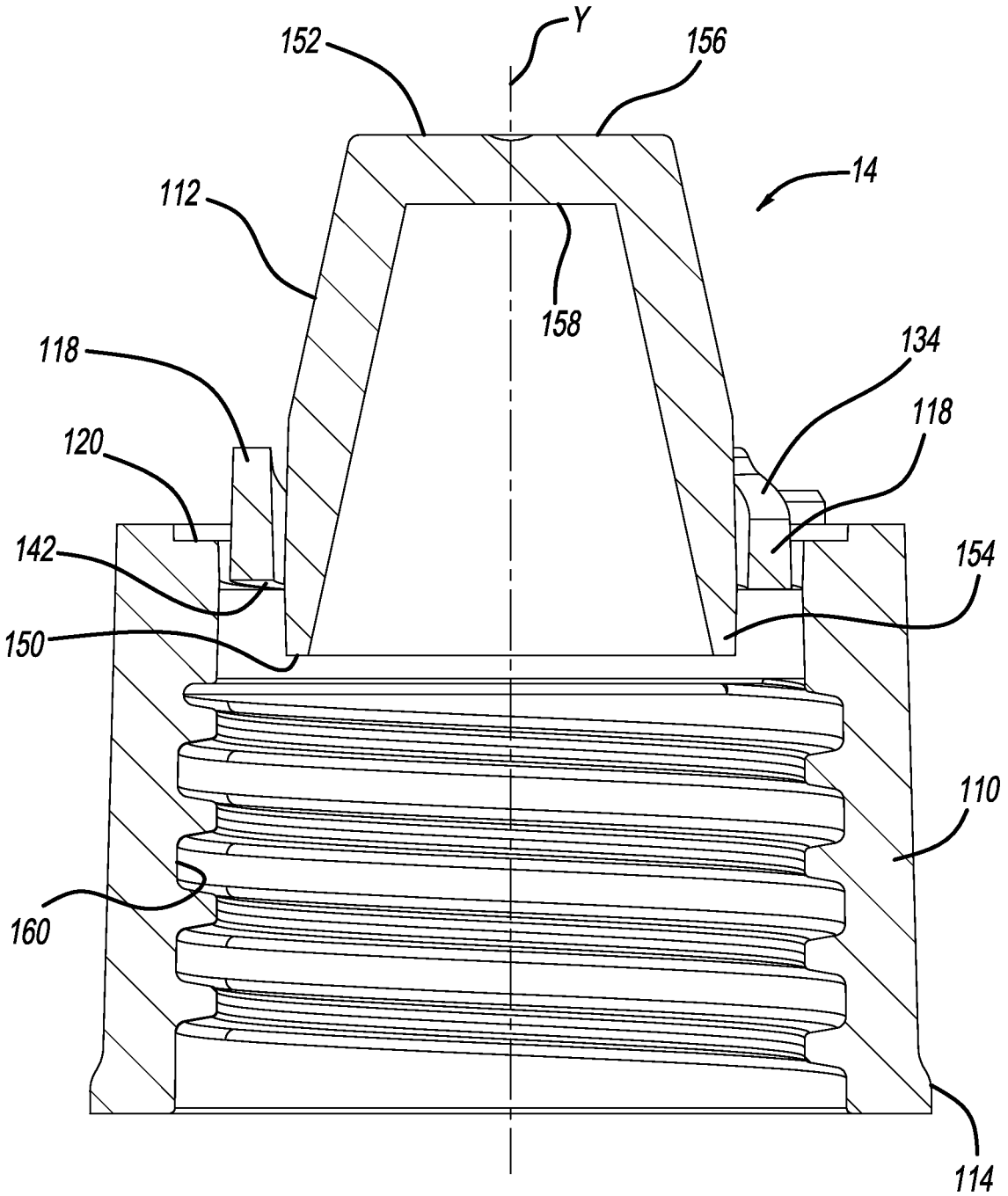
FIG. 9 is a cross-sectional view taken along line 9-9 of FIG. 7.

With particular reference to FIG. 9, the lower ramped surface 142 of each ramped spring 118 is pitched to match the pitch of the finish threads 28 and the inner threads 160. The inner cone portion 112 includes a proximal end 150 and a distal end 152 opposite thereto. The proximal end 150 is within the inner body 110, and the distal end 152 is furthest from the inner body 110. At the proximal end 150 is an inner flange 154, which extends about the longitudinal axis Y. At the distal end 152 is an outer surface 156 and an inner surface 158, which is opposite to the outer surface 156. When the inner threads 160 of the inner body 110 are threaded onto the finish threads 28 of the finish 20, the inner portion 14 forms two seals at the extended control dropper tip 40, as illustrated in FIG. 10 for example. The first seal is formed between the inner flange 154 and the tip flange 44. The second seal is formed between the inner surface 158 and the distal end 50 of the spout 46.

Figure 12:
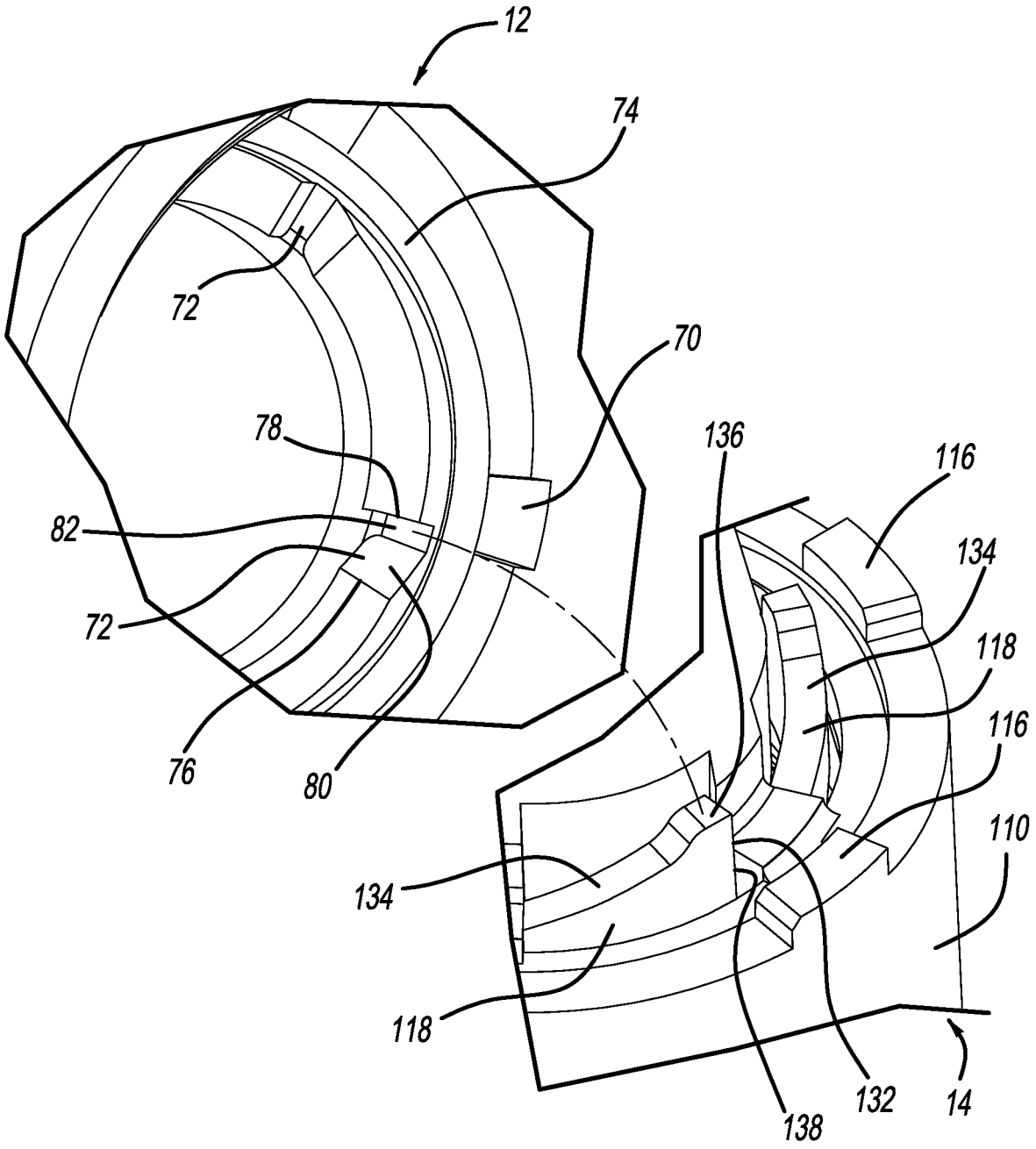
FIG. 12 illustrates interaction between the ramped springs of the inner portion of the container and the protrusions of the outer portion of the container.

With reference to FIGS. 10-12, for example, the outer portion 12 is seated on the inner portion 14 such that the outer cone portion 62 is seated over the inner cone portion 112, and outer body 60 overlaps the inner body 110 and is retained thereon by cooperation between the retaining bead 90 of the outer portion 12 and the skirt 114 of the inner portion 14. The outer and inner portions 12 and 14 are positioned such that the outer drive teeth 70 and the inner drive teeth 116 are at a common distance from the longitudinal axis Y. The annular flange 74 of the outer portion 12 is aligned with, and may extend into, the annular channel 120 of the inner portion 14. The protrusions 72 and the ramped springs 118 are at a common distance from the longitudinal axis Y such that the protrusions 72 are configured to contact the ramped springs 118 during rotation of the outer portion 12 relative to the inner portion 14, as described herein.

When the closure 10 is secured to the finish 20 through cooperation between the inner threads 160 of the inner portion 14 and the finish threads 28 of the finish 20, the ramped springs 118 are generally vertically aligned with the finish 20 and do not extend outward beyond the outer surface 30 of the finish 20, which advantageously provides for a compact arrangement suitable for use with smaller finishes, such as the finish 20 of dropper container 24. Thus the ramped springs 118 do not extend outward beyond the outer diameter of the finish ODf, and do not extend outward to the finish threads 28 or the inner threads 160.

The operation of opening and closing the closure 10 to the finish 20 will now be described in detail. To secure the closure 10 onto the finish 20, the inner threads 160 are mated with the finish threads 28 and the closure 10 is rotated in a first direction, which is described herein as a clockwise or closing direction. Although the closure 10 is described and illustrated herein as configured for tightening upon rotation in a clockwise direction, the closure 10 can be configured such that tightening occurs when the closure 10 is rotated in a counterclockwise direction. Upon rotating the closure 10 in the clockwise direction, and specifically rotating the outer portion 12 in the clockwise direction, the second ends 78 of the protrusions 72 on the outer portion 12 contact the vertical face 138 of the ramped springs 118 to rotate the inner portion 14 together with the outer portion 12 in order to thread the closure 10 onto the finish 20. Advantageously, there is no need to push the outer portion 12 onto the inner portion 14 during this tightening. During tightening, the outer drive teeth 70 pass over the inner drive teeth 116 such that the outer and inner drive teeth 70 and 116 do not contact one another during typical re-secure operation. However, if the outer portion 12 is pressed onto the inner portion 14 during tightening, the outer and inner drive teeth 70 and 116 may engage such that the outer drive teeth 70 drive the inner drive teeth 116 and thus drive the inner portion 14. The closure 10 is turned in the clockwise direction until the inner threads 160 are tightly threaded on the finish threads 28 to secure the closure 10 onto the finish 20.

Once the closure 10 is secured onto the finish threads 28, rotation of the closure 10 in a counterclockwise opening direction will not loosen the closure 10 unless the outer portion 12 is pushed onto the inner portion 14, thus providing a child resistant securing feature. Specifically, when the outer portion 12 is rotated counterclockwise without being pushed onto the inner portion 14, the protrusions 72 will ride over each one of the ramped springs 118, thus resulting in the outer portion 12 rotating about the inner portion 14 without the outer portion 12 engaging or rotating the inner portion 14. Specifically, the sloped surfaces 80 of the protrusions 72 will contact and slide over the ramped surfaces 134 of the ramped springs 118 and ultimately over the raised teeth 136, which will raise the outer drive teeth 70 above the inner drive teeth 116 such that the outer and inner drive teeth 70 and 116 do not contact and do not engage one another, which enables the outer portion 12 to rotate generally freely about the inner portion 14 without rotating the inner portion 14.

Once the closure 10 is secured onto the finish 20 and over the tip 40, the two seals described above are formed in order to prevent material from leaking out through the tip 40. Specifically, the first seal is formed between the inner flange 154 of the inner portion 14 and the tip flange 44 of the extended control dropper tip 40. The second seal is formed between the inner surface 158 of the inner cone portion 112 and the distal end 50 of the spout 46, as illustrated in FIGS. 10 and 11 for example.

To remove the closure 10 from the finish 20, the outer portion 12 must be pressed onto the inner portion 14 (see FIG. 11) as the closure 10 is rotated in the counter clockwise opening direction. As a result, the protrusions 72 ride along the ramped springs 118 such that interaction between the sloped portions 80 of the protrusions 72 and the ramped surface 134 of the ramped springs 118 causes the ramped springs 118 to flex downward and into the inner body 110. The ramped springs 118 flex furthest into the inner body 110 when the planer portions 82 contact the raised teeth 136. Due to the ramped springs 118 flexing into the inner body 110, the outer drive teeth 70 are no longer suspended above the inner drive teeth 116, which allows the outer and inner drive teeth 70 and 116 to interlock such that counterclockwise rotation of the outer portion 12 rotates the inner portion 14 in a counterclockwise direction thereby unscrewing the closure 10 off of the finish threads 28. After the inner portion 14 is rotated slightly so that it is no longer tightly interlocked with the inner threads 160, and is thus able to rotate in a generally free manner, there is no need to continue to depress the outer portion 12 onto the inner portion 14 because when the protrusions 72 of the outer portion 12 contact the ramped springs 118 at the ramped surface 134 or the raised teeth 136 (or just prior to the raised teeth 136), this interaction will cause the outer portion 12 to rotate the inner portion 14. The protrusions 72 will not pass over the ramped springs 118 thereby making it unnecessary to continue to depress the outer portion 12 onto the inner portion 14.

The present teachings thus provide an improved child resistant closure, such as the illustrated closure 10, which can be used on small containers, such as the dropper container 24.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers that may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A child resistant closure for a container comprising:

an inner portion including:

internal threads configured to cooperate with a finish of the container;

a plurality of ramped springs spaced apart circumferentially about a longitudinal axis of the closure, each one of the plurality of ramped springs includes the following: a first end, a second end opposite to the first end, an upper ramped surface and a lower ramped surface each extending from the first end towards the second end, one or more raised teeth extending from the upper ramped surface to the second end, and a face at the second end; and a plurality of inner drive teeth spaced apart circumferentially about the longitudinal axis outboard of the plurality of ramped springs;

an outer portion seated over the inner portion, the outer portion including:

a plurality of protrusions spaced apart circumferentially about the longitudinal axis and configured to contact the plurality of ramped springs; and a plurality of outer drive teeth spaced apart circumferentially about the longitudinal axis outboard of the plurality of protrusions and configured to contact the plurality of inner drive teeth.

2. The child resistant closure of claim 1, wherein the plurality of ramped springs are inboard of the internal threads such that the plurality of ramped springs are closer to the longitudinal axis than the internal threads.

3. The child resistant closure of claim 1, wherein the inner portion includes a body including the plurality of inner drive teeth at a first end of the body, and an outwardly extending skirt at a second end opposite to the first end, the skirt configured to contact a retaining bead at an interior of the outer portion to secure the inner portion and the outer portion together.

4. The child resistant closure of claim 1, wherein the face extends substantially vertical and parallel to the longitudinal axis.

5. The child resistant closure of claim 1, wherein:

each one of the plurality of ramped springs is curved from the first end to the second end and is concave relative to the longitudinal axis; and wherein the lower ramped surface and the internal threads have a common pitch.

6. The child resistant closure of claim 1, wherein each one of the ramped springs includes a hinge at the first end.

7. The child resistant closure of claim 1, wherein the inner portion includes an inner flange extending circumferentially about the longitudinal axis and configured to contact a tip flange of a spout to provide a first seal between the inner flange and the tip flange; and wherein the inner portion includes an inner cone having a distal cone end configured to contact a distal end of the spout to provide a second seal between the inner cone and the distal end of the spout.

8. The child resistant closure of claim 1, wherein each one of the plurality of protrusions includes a first end, a second end opposite to the first end, and a sloped surface extending from the first end towards the second end.

9. The child resistant closure of claim 1, the outer portion further including an annular flange between the plurality of protrusions and the plurality of outer drive teeth, the longitudinal axis extends through an axial center of the annular flange, wherein the annular flange prevents flexing of the ramped springs perpendicular to the longitudinal axis.

10. The child resistant closure of claim 9, wherein the annular flange of the outer portion is between the plurality of ramped springs and the plurality of inner drive teeth of the inner portion.

11. The child resistant closure of claim 9, wherein when the closure is seated on the finish of the container:

rotation of the outer portion in a first direction causes the protrusions to contact faces of the ramped springs to rotate the inner portion together with the outer portion and thread the inner portion onto the finish through cooperation between the internal threads of the inner portion and finish threads of the container;

rotation of the outer portion in a second direction opposite to the first direction without pressing the outer portion onto the inner portion causes the plurality of protrusions of the outer portion to contact and slide over the plurality of ramped springs, thereby permitting rotational movement of the outer portion in the second direction without moving the inner portion; and rotation of the outer portion in the second direction while pressing the outer portion onto the inner portion causes the protrusions to contact and depress the plurality of ramped springs and moves the plurality of outer drive teeth into contact with the plurality of inner drive teeth to rotate the inner portion together with the outer portion and permit loosening and removal of the closure from engagement with the finish.

12. A child resistant closure for a container comprising:

an inner portion including:

internal threads configured to cooperate with a finish of the container;

a plurality of ramped springs spaced apart circumferentially about a longitudinal axis of the closure, the plurality of ramped springs are inboard of the internal threads and finish threads of the container such that the plurality of ramped springs are closer to the longitudinal axis than both the internal threads and the finish threads; and a plurality of inner drive teeth spaced apart circumferentially about the longitudinal axis outboard of the plurality of ramped springs;

an outer portion seated over the inner portion, the outer portion including:

a plurality of protrusions spaced apart circumferentially about the longitudinal axis and configured to contact the plurality of ramped springs;

a plurality of outer drive teeth spaced apart circumferentially about the longitudinal axis outboard of the plurality of protrusions and configured to contact the plurality of inner drive teeth; and an annular flange between the plurality of protrusions and the plurality of outer drive teeth, the annular flange extends to an area of the inner portion between the plurality of ramped springs and the plurality of inner drive teeth, wherein the annular flange prevents flexing of the ramped springs perpendicular to the longitudinal axis.

13. The child resistant closure of claim 12, wherein:

each one of the plurality of ramped springs includes a hinge at the first end and a vertical face at the second end; and rotation of the outer portion in a tightening direction causes the protrusions to contact the vertical faces of the ramped springs to rotate the inner portion together with the outer portion and thread the inner portion onto the finish through cooperation between the internal threads of the inner portion and finish threads of the container.

14. The child resistant closure of claim 12, wherein rotation of the outer portion in a loosening direction opposite to a tightening direction without pressing the outer portion onto the inner portion causes the plurality of protrusions of the outer portion to contact and slide over the plurality of ramped springs, thereby permitting rotational movement of the outer portion in the loosening direction without moving the inner portion.

15. The child resistant closure of claim 12, wherein rotation of the outer portion in a loosening direction opposite to a tightening direction while pressing the outer portion onto the inner portion causes the protrusions to contact and depress the plurality of ramped springs and moves the plurality of outer drive teeth into contact with the plurality of inner drive teeth to rotate the inner portion together with the outer portion and permit loosening and removal of the closure from engagement with the finish.

16. A child resistant closure for a container comprising:

an inner portion including:

internal threads configured to cooperate with a finish of the container;

a plurality of ramped springs spaced apart circumferentially about a longitudinal axis of the closure, each one of the plurality of ramped springs includes: a first end, a second end opposite to the first end, an upper ramped surface, and a lower ramped surface extending from the first end towards the second end;

the plurality of ramped springs are: inboard of the internal threads; inboard of the finish threads; curved from the first end to the second end so as to be concave relative to the longitudinal axis; and do not extend beyond an outer diameter of the finish of the container such that the plurality of ramped springs are closer to the longitudinal axis than both the internal threads and the finish threads; and a plurality of inner drive teeth spaced apart circumferentially about the longitudinal axis outboard of the plurality of ramped springs;

an outer portion seated over the inner portion, the outer portion including:

a plurality of protrusions spaced apart circumferentially about the longitudinal axis and each including a sloped portion configured to contact the plurality of ramped springs;

a plurality of outer drive teeth spaced apart circumferentially about the longitudinal axis outboard of the plurality of protrusions and configured to contact the plurality of inner drive teeth; and an annular flange between the plurality of protrusions and the plurality of outer drive teeth, the annular flange extends to an area of the inner portion between the plurality of ramped springs and the plurality of inner drive teeth.

17. The child resistant closure for a container of claim 16, wherein when the closure is seated on the finish of the container:

rotation of the outer portion in a first direction causes the sloped portions of the protrusions to contact faces of the ramped springs to rotate the inner portion together with the outer portion and thread the inner portion onto the finish through cooperation between the internal threads of the inner portion and finish threads of the container;

rotation of the outer portion in a second direction opposite to the first direction without pressing the outer portion onto the inner portion causes the plurality of protrusions of the outer portion to contact and slide over the plurality of ramped springs, thereby permitting rotational movement of the outer portion in the second direction without moving the inner portion; and rotation of the outer portion in the second direction while pressing the outer portion onto the inner portion causes the protrusions to contact and depress the plurality of ramped springs and moves the plurality of outer drive teeth into contact with the plurality of inner drive teeth to rotate the inner portion together with the outer portion and permit loosening and removal of the closure from engagement with the finish.

18. The child resistant closure for a container of claim 16, wherein the inner portion includes an inner flange extending circumferentially about the longitudinal axis and configured to contact a tip flange of a spout to provide a first seal between the inner flange and the tip flange; and wherein the inner portion includes an inner cone having a distal cone end configured to contact a distal end of the spout to provide a second seal between the inner cone and the distal end of the spout.

19. The child resistant closure for a container of claim 16, wherein the lower ramped surface of the ramped springs and the internal threads have a common pitch.

20. A child resistant closure for a container comprising:

an inner portion including:

internal threads configured to cooperate with a finish of the container;

a plurality of ramped springs spaced apart circumferentially about a longitudinal axis of the closure; and a plurality of inner drive teeth spaced apart circumferentially about the longitudinal axis outboard of the plurality of ramped springs;

an outer portion seated over the inner portion, the outer portion including:

a plurality of protrusions spaced apart circumferentially about the longitudinal axis and configured to contact the plurality of ramped springs;

a plurality of outer drive teeth spaced apart circumferentially about the longitudinal axis outboard of the plurality of protrusions and configured to contact the plurality of inner drive teeth; and an annular flange between the plurality of protrusions and the plurality of outer drive teeth, the longitudinal axis extends through an axial center of the annular flange, wherein the annular flange prevents flexing of the ramped springs perpendicular to the longitudinal axis.

21. A child resistant closure for a container comprising:

an inner portion including:

internal threads configured to cooperate with a finish of the container;

a plurality of ramped springs spaced apart circumferentially about a longitudinal axis of the closure, the plurality of ramped springs are inboard of the internal threads and finish threads of the container such that the plurality of ramped springs are closer to the longitudinal axis than both the internal threads and the finish threads, each one of the plurality of ramped springs includes a hinge at the first end and a vertical face at the second end; and a plurality of inner drive teeth spaced apart circumferentially about the longitudinal axis outboard of the plurality of ramped springs;

an outer portion seated over the inner portion, the outer portion including:

a plurality of protrusions spaced apart circumferentially about the longitudinal axis and configured to contact the plurality of ramped springs; and a plurality of outer drive teeth spaced apart circumferentially about the longitudinal axis outboard of the plurality of protrusions and configured to contact the plurality of inner drive teeth;

wherein rotation of the outer portion in a tightening direction causes the protrusions to contact the vertical faces of the ramped springs to rotate the inner portion together with the outer portion and thread the inner portion onto the finish through cooperation between the internal threads of the inner portion and finish threads of the container.

* * * * *